United States Patent [19]

Ferguson et al.

[11] Patent Number: 4,752,381

[45] **Date of Patent: * Jun. 21, 1988**

[54] UPGRADING PETROLEUM AND PETROLEUM FRACTIONS

[75] Inventors: Sam Ferguson, Sugar Land; Darrell D. Reese, Richmond, both of Tex.

[73] Assignee: Nalco Chemical Company, Naperville, Ill.

[ * ] Notice: The portion of the term of this patent subsequent to May 20, 2003 has been disclaimed.

[21] Appl. No.: 51,557

[22] Filed: May 18, 1987

[51] Int. Cl.[4] ..... C10G 17/00

[52] U.S. Cl. ..... 208/263; 208/289; 106/27; 106/28; 106/32

[58] Field of Search ..... 208/263; 106/27, 28, 106/32

[56] References Cited

U.S. PATENT DOCUMENTS

| | | | |
|---|---|---|---|
| Re. 28,533 | 8/1975 | Drawert et al. | 106/27 |
| 2,018,758 | 10/1935 | Ellis | 37/9 |
| 2,152,720 | 4/1939 | Yabroff | 196/32 |
| 2,152,723 | 4/1939 | Yabroff | 196/32 |
| 2,238,045 | 4/1941 | Fulton | 252/42 |
| 2,279,277 | 4/1942 | Shoemaker | 208/263 |
| 2,355,837 | 8/1944 | Wilson | 260/309.6 |
| 2,424,158 | 7/1947 | Fuqua et al. | 196/41 |
| 2,701,783 | 2/1955 | Long et al. | 196/14.12 |
| 2,769,767 | 11/1956 | Fierce et al. | 196/41 |
| 2,769,768 | 11/1956 | Fierce et al. | 196/41 |
| 2,797,188 | 6/1957 | Taylor et al. | 208/263 |
| 2,808,431 | 10/1957 | Fierce | 260/514 |
| 2,878,181 | 3/1959 | Ayers et al. | 208/263 |
| 2,956,946 | 10/1960 | King et al. | 208/263 |
| 3,176,041 | 3/1965 | Ayers et al. | 260/514 |
| 3,850,648 | 11/1974 | Riedel et al. | 106/27 |
| 3,900,436 | 8/1975 | Drawert et al. | 106/27 |
| 3,997,469 | 12/1976 | Howle | 252/392 |
| 4,293,432 | 10/1981 | Papay et al. | 252/51.5 A |
| 4,430,196 | 2/1984 | Hiu | 208/47 |
| 4,589,979 | 5/1986 | Ferguson et al. | 208/263 |

OTHER PUBLICATIONS

The Naphthenic Acids in Kirk-Othmer's Encyclopedia of Chemical Technology, 3rd Edition, vol. 15, John Wiley and Sons, 1981.

*Primary Examiner*—H. M. S. Sneed
*Assistant Examiner*—Helane Myers
*Attorney, Agent, or Firm*—John G. Premo; Anthony L. Cupoli; Donald G. Epple

[57] ABSTRACT

A method of neutralizing the organic acidity in petroleum and petroleum fractions to produce a neutralization number less than 1.0 whereby they are rendered suitable as lube oil feed stocks which comprises treating said heavy gas oils with a neutralizing amount of monoethanolamine to form an amine salt with the organic acids and then heating the thus-neutralized petroleum or petroleum fraction at a temperature and for a time sufficient to convert the amine salts to amides.

4 Claims, No Drawings

UPGRADING PETROLEUM AND PETROLEUM FRACTIONS

INTRODUCTION

A variety of petroleum fractions as well as petroleum itself contain acidity in the form of naphthenic acids. This invention relates to a method of neutralizing the acidity in these liquids to improve their quality.

THE INVENTION

The invention comprises method of neutralizing the organic acidity in petroleum and petroleum fractions to produce a neutralization number less than 1.0 whereby they are rendered suitable as lube oil feed stocks which comprises treating said petroleum and petroleum fractions with a neutralizing amount of monoethanolamine to form an amine salt with the organic acids and then heating the thus-neutralized petroleum and petroleum fractions at a temperature and for a time sufficient to convert the amine salts to amides.

The amount of monoethanolamine necessary to produce neutralization of petroleum and petroleum fractions which have a neutralization number greater than 1.0 can best be determined by using titration techniques or by trial and error.

As indicated, after the amine has been added to the oil and salt formation occurs, the salts should be converted substantially to their amides. This can be done at temperatures about 25° F. greater than the boiling point of water for a period of time ranging over several days or higher temperatures can be employed and shorter reaction times used. Typically, if one were to heat the salt product at about 400°-500° F. for between 1-2 hours, the amide formation would take place.

Heating the salt product at between about 400°-500° F. for the time period mentioned above, provides for amide formation, particularly if the system is under a slight back pressure that might be expected in these operations at these temperatures. Obviously, a person familiar with the art would realize that as the temperature increase above 500° F., and particularly above 600° F., the back pressures required to control the formation of these amide compounds would be higher. These back pressures and the effectiveness of the formation of the amide compounds of this invention can be easily determined by trial and error procedures well known to the artisan.

Illustrative of the various petroleum fractions that may be treated in accordance with the invention are light and heavy gas oils, transformer oils, class A and B, refrigerator oils, chain saw bar oils, ink oils, motor oils, metal cutting oils, and machine oils.

A particularly useful stock that is benefited by the practices of the invention is the deacidification of ink oils. Ink oils are fractions of aliphatic hydrocarbons with high naphthenic content. These oils are used in inks dried by heat and have boiling points from 400° to 650° F. Concentrations of ink oils by weight of only 21% are found in sheet-fed offset and heat-set offset inks.

EXAMPLE

In order to evaluate the invention, a virgin gas oil was selected from a refinery located in the southern part of the United States. The neutralization number of this gas oil was 3.54. The neutralization number was determined using the well known ASTM procedure D-974.

To determine the effectiveness of different amines at lowering the neutralization number, a weighed amount of the test vacuum gas oil and the additive were refluxed at between 450°-500° F. for 1.5 hours. This converted the salt formed by neutralization to the amide.

The corrosivity of the vacuum gas oil was determined by refluxing a weighed amount of VGO for six (6) hours at 500° F. with mild steel coupons immersed in the liquid. To measure the corrosivity after neutralization, a weighed amount of VGO and additive were refluxed at 450°-500° F. for 1.5 hours, then mild steel coupons were immersed in the liquid and the reflux continued for six (6) hours at 500° F.

Using the above test procedure, the results are presented below in Table I.

TABLE I

| Additive | Concentration | Neutralization Number |
|---|---|---|
| Blank | — | 3.54 |
| Polyamine* Bottoms | 1.43% | 2.45 |
| Polyamine Bottoms | 2.86% | 1.90 |
| Polyamine Bottoms | 6.0% | 1.20 |
| Tetraethylene** Pentamine | 2.0% | 0.54 |
| Tetraethylene Pentamine | 1.0% | 0.82 |
| Monoethanolamine | 0.3% | 1.63 |
| Monoethanolamine | 0.45% | 1.22 |
| Monoethanolamine | 0.6% | 0.82 |

| Corrosion Study | |
|---|---|
| Blank | 42 mpy |
| 0.6% Monoethanolamine | 22 mpy |

*A mixture of aliphatic and heterocyclic amines with boiling range between 410-465° F., Sp.G. ranging between 0.98-1.09 with multiple amine substituents.

**A mixture containing: 65 weight percent of major isomers
1. linear triethylene pentamine
2. linear tetra ethylene pentamine
3. amino ethyl tris - amino ethylamine
4. amino ethyl diamino ethyl piperazine
5. aminoethyl piperazino ethyl ethylene diamine
6. piperazino ethyl diamino ethyl amine
7. bis-piperazino ethyl amine, and 25 weight percent of the following major isomers:
(1) linear triethylene tetramine
(2) tris-amino ethylamine
(3) piperazino ethyl ethylene diamine
(4) bis-aminoethyl piperazine, and about 10 weight percent of:
1. pentaethylene hexamine
2. other linear, branched, and cyclic congenors of smiliar amino structures.

We claim:

1. A method of neutralizing the organic naphthenic acids acidity present in petroleum and petroleum fractions to produce a neutralization number less than 1.0 whereby they are rendered suitable as lube oil feed stocks which consists essentially of treating said petroleum and petroleum fractions with a neutralizing amount of monoethanolamine to form an amine salt with the organic acids and then heating the thus-neutralized petroleum and petroleum fractions at a temperature at least about 25° F. greater than the boiling point of water and for a time sufficient to convert the amine salts to amides.

2. The method of claim 1 wherein the neutralized petroleum and petroleum fractions are heated at a temperature of about 400°-500° F. for between 1-2 hours.

3. The method of claim 1 where the petroleum fraction is from the group consisting of light and heavy gas oils, transformer oils, class A and B, refrigerator oils, chain saw bar oils, ink oils, motor oils, metal cutting oils, and machine oils.

4. The method of claim 3 where the petroleum fraction is an ink oil.

* * * * *